United States Patent [19]

Koenigsberg et al.

[11] Patent Number: 4,506,192

[45] Date of Patent: Mar. 19, 1985

[54] FLUORESCENT LAMP AND A BASE THEREOF

[75] Inventors: William D. Koenigsberg, Concord, Mass.; Arthur J. Wagenknecht, York, Pa.

[73] Assignee: GTE Laboratories Incorporated, Waltham, Mass.

[21] Appl. No.: 468,238

[22] Filed: Feb. 22, 1983

[51] Int. Cl.[3] ..... H01J 7/44; H01J 17/34; H01J 19/78; H01J 29/96

[52] U.S. Cl. ..... 315/71; 315/58; 315/60; 313/51; 313/318; 313/624; 339/50 R; 339/207 R; 339/209; 339/206 L

[58] Field of Search ..... 315/71, 65, 58, 60; 313/493, 51, 624, 625, 318; 339/207, 209, 214 C, 206 L, 50, 53

[56] References Cited

U.S. PATENT DOCUMENTS

| | | | |
|---|---|---|---|
| 2,508,118 | 5/1950 | Lemmers | 315/71 |
| 2,767,349 | 10/1956 | Feinberg | 339/53 |
| 3,688,148 | 8/1972 | Fedorenko et al. | 313/493 |

FOREIGN PATENT DOCUMENTS

| | | | |
|---|---|---|---|
| 401128 | 11/1933 | United Kingdom | 315/71 |

*Primary Examiner*—Saxfield Chatmon
*Attorney, Agent, or Firm*—Ivan L. Ericson

[57] ABSTRACT

A rapid start fluorescent lamp having an external conductive strip has a resistive element in the lamp base electrically connected to the conductive strip and a pin of the lamp base. The resistive element is made from a material which has a volume resistivity of about $10^5$ to about $10^8$ ohm-cm and a deflection temperature greater than 250° C. at 1,820 kilo dynes/cm$^2$. The resistive element is mounted in the lamp base metal housing and supports the metal pins or the resistive element is made into a washer shaped element and attached to one of the pins on the inside of the lamp base.

4 Claims, 4 Drawing Figures

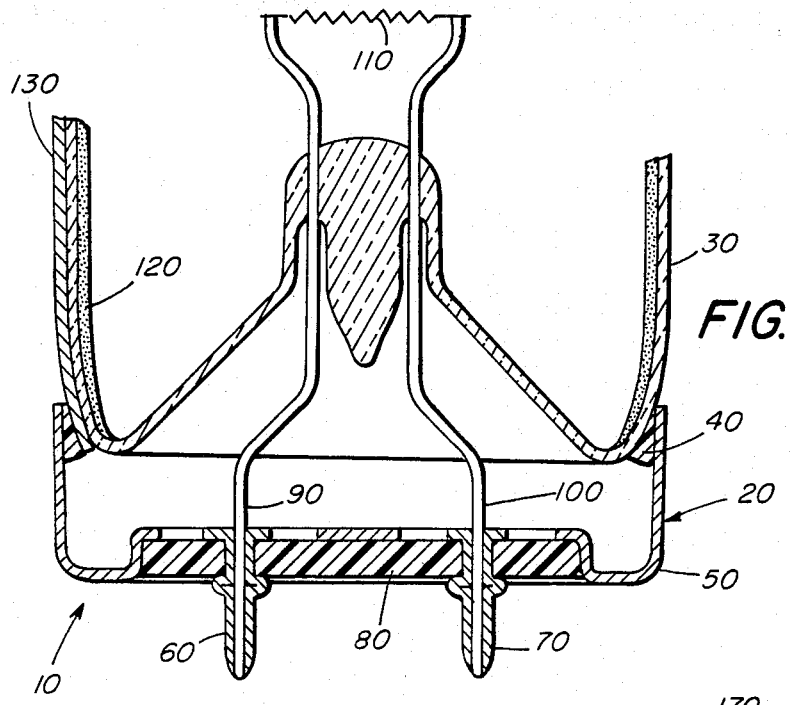
FIG. 1
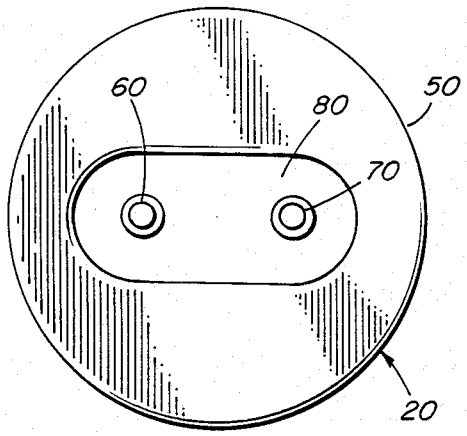
FIG. 2
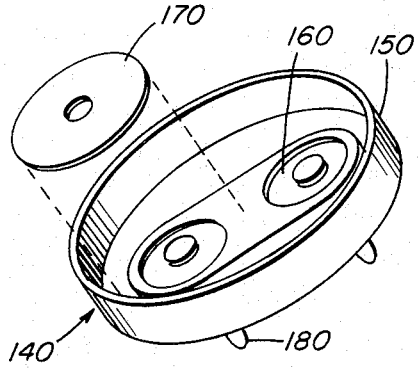
FIG. 4
FIG. 3
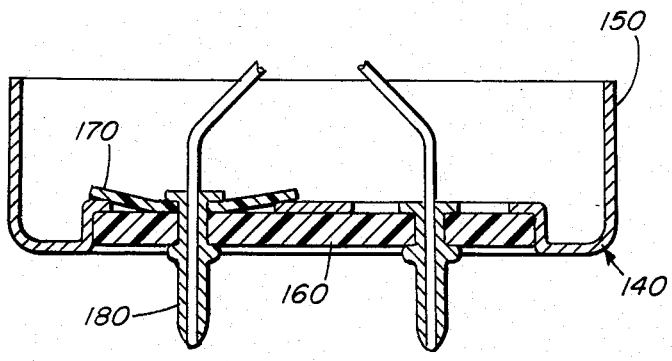

FLUORESCENT LAMP AND A BASE THEREOF

FIELD OF THE INVENTION

This invention relates to fluorescent lamps. More particularly, this invention relates to rapid start fluorescent lamps and rapid start fluorescent lamp bases.

BACKGROUND OF THE INVENTION

Rapid start fluorescent lamps use starting aids in the form of a conductive strip on the outside surface of the fluorescent lamps. The effectiveness of such strips can be enhanced by electrically connecting one end of the strip to one of the lamp base pins by means of a high impedance element such as a discrete axial-lead resistor.

The mounting of the axial-lead resistor requires a lead bending and forming operation, an insulating barrier to prevent inadvertent contact of the wire lead and the metal base, and two staking operations to mechanically and electrically join the wire lead and pin on one side, and the other wire lead and the metal base on the other side. All these operations are labor intensive and therefore, costly.

SUMMARY OF THE INVENTION

An object of the present invention is to provide a new and improved fluorescent lamp and fluorescent lamp base which will eliminate the costly labor intensive operations required to mount axial-lead type resistors.

A new and improved fluorescent lamp base in accordance with the present invention, comprises a metal housing, metal pins for connection to a source of power, and a resistive supporting member. The resistive supporting member mounted in the metal housing supports the metal pins and provides a high impedance electrical connection between the metal housing and the metal pins. The resistive supporting member is made from a material which has a volume resistivity from about $10^5$ to about $10^8$ ohm-cm and a deflection temperature greater than 250° C. at 1,820 kilo dynes/cm$^2$.

In accordance with another aspect of the present invention, a new and improved fluorescent lamp base comprises a metal housing, metal pins for connection to a source of power, an electrically insulated support member mounted in the metal housing, and a resistive member. The electrically insulated support member supports the metal pins and provides electrical insulation between the metal housing and the metal pins. The resistive member provides a high impedance electrical connection between the metal housing and one of the metal pins. The resistive member is made from a material which has a volume resistivity from about $10^5$ to about $10^8$ ohm-cm and a deflection temperature greater than 250° C. at 1,820 kilo dynes/cm$^2$. The resistive member is attached to one of the metal pins and is electrically connected to the inside surface of the metal housing and to the metal pin.

In accordance with still another aspect of the present invention, a new and improved fluorescent lamp comprises a light-transmitting envelope, electrodes, electrode leads, an inert ionizable gas, a charge of mercury, a coating of phosphor on the inside surface of the envelope, and a new and improved fluorescent lamp base. The new and improved fluorescent lamp base comprises a metal housing, metal pins for connection to a source of power, and a resistive supporting member mounted in the metal housing. The resistive supporting member supports the metal pins and provides a high impedance electrical connection between the metal housing and the metal pins. The resistive supporting member is made from a material which has a volume resistivity from about $10^5$ to about $10^8$ ohm-cm and a deflection temperature greater than 250° C. at 1,820 kilo dynes/cm$^2$. The envelope has an electrically conductive strip on the exterior surface of the envelope terminating within the vicinity of the electrode leads. The new and improved fluorescent lamp base is attached to an end of the envelope and the metal housing of the new and improved fluorescent lamp base is electrically connected to the conductive strip.

In accordance with a further aspect of the present invention, a new and improved fluorescent lamp comprises a light-transmitting envelope, electrodes, electrode leads, an inert ionizable gas, a charge of mercury, a coating of phosphor on the inside surface of the envelope, and a new and improved fluorescent lamp base.

The new and improved fluorescent lamp base comprises a metal housing, metal pins for connection to a source of power, an electrically insulated support member mounted in the metal housing and a resistive member. The resistive member provides a high impedance electrical connection between the metal housing and one of the metal pins. The resistive member is made from a material which has a volume resistivity from about $10^5$ to about $10^8$ ohm-cm and a deflection temperature greater than 250° C. at 1,820 kilo dynes/cm$^2$.

The envelope has an electrically conductive strip on the exterior surface of the envelope. The conductive strip terminates within the vicinity of the electrode leads. The new and improved fluorescent lamp base is attached to an end of the envelope and the metal housing of the new and improved fluorescent lamp base is electrically connected to the conductive strip.

BRIEF DESCRIPTION OF THE DRAWING

In the drawing:

FIG. 1 is a partial sectional view of a fluorescent lamp base showing the resistive supporting member and a partial sectional view of a fluorescent lamp in accordance with the present invention.

FIG. 2 is an outside bottom view of the fluorescent lamp base of FIG. 1 showing the resistive supporting member in accordance with the present invention.

FIG. 3 is a partial sectional view of a modification in accordance with the present invention.

FIG. 4 is a perspective view of the fluorescent lamp base shown, in part, in FIG. 3, showing the modification in accordance with the present invention.

For a better understanding of the present invention, together with other and further objects, advantages and capabilities thereof, reference is made to the following disclosure and appended claims in connection with the above-described drawing.

DETAILED DESCRIPTION OF THE PREFERRED EMBODIMENTS

Referring now to the drawings with greater particularity, there is shown in FIG. 1 a fluorescent lamp 10 comprising a fluorescent lamp base 20 attached to a fluorescent lamp envelope 30 by basing cement 40. The fluorescent lamp base 20 has a metal housing 50, metal pins 60, 70; and a resistive supporting member 80. The resistive supporting member 80 mounted in the metal housing 50 supports the metal pins 60 and 70 and provides a high impedance electrical connection between the metal housing 50 and the metal pins 60 and 70. The resistive supporting member 80 is made from a material which has a volume resistivity from about $10^5$ to about $10^8$ ohm-cm, preferably from about $5\times10^6$ to about $5\times10^7$ ohm-cm, and a deflection temperature greater than 250° C. at 1,820 kilo dynes/cm$^2$ to provide a high impedance value such as 10 meg ohms.

The resistive supporting member must withstand the heat encountered during the basing cement curing step such as 250° C. for 30 seconds and have a volume resistivity greater than $10^5$ ohm-cm. A resistance between the metal housing 50 and the metal pins 60, 70 is chosen to limit current to a safe valve.

A specific material which will meet the temperature requirements and have the required volume resistivity, is a conductive fiber glass reinforced polyester such as FRP/SDL made by Static Technology Division, Meriden Molded Plastics, Meriden, CT 06450. This material has a deflection temperature of 265° C. at 1,820 kilo dynes/cm$^2$ (ASTM D648) and a volume resistivity between $10^5$ to $10^8$ ohm-cm (ASTM D257).

The metal pins 60, 70 are electrically connected to electrode leads 90, 100 of electrode 110. The metal pins 60, 70 are for connections to a source of power (not shown in the drawing).

The fluorescent lamp 10 has a phosphor 120 coating on the interior surface of the fluorescent lamp envelope 30, and an electrically conductive strip 130 on the exterior surface of the fluorescent lamp envelope 30. The electrically conductive strip 130 terminates within the vicinities of electrode leads 90, 100 and is electrically connected to the metal housing 50 of the fluorescent lamp base 20.

FIG. 2 is an exterior view of the fluorescent lamp base 20 showing the metal housing 50, the metal pins 60, 70 and the resistive supporting member 80.

FIGS. 3 and 4 show a modification of a fluorescent lamp base 140. The metal housing 150 has an insulator supporting member 160 instead of a resistive supporting member 80 shown in FIGS. 1 and 2 and a resistive member 170 such as a washer shaped resistive member or a resistive member having an aperture. The resistive member 170 provides a high impedance electrical connection between the metal housing 150 and a metal pin 180. The resistive member 170 is made from a material which has a volume resistivity from about $10^5$ to about $10^8$ ohm-cm and a deflection temperature greater than 250° C. at 1,820 kilo dynes/cm$^2$.

FIG. 4 shows a perspective view of the modification shown in FIG. 3. The resistive member 170 can be installed in the fluorescent lamp base 140 automatically by inserting the resistive member 170, such as a washer shaped resistive member or a resistive member having an aperture, over an end of the metal pin 180 and securing it by crimping the end of the pin over the resistive member 170 during the staking operation. It may be necessary to apply a conductive film coating on the surface of the resistive member 170 at the regions of contact to assure electrical contact.

While there has been shown and described what is at present considered the preferred embodiments of the invention, it will be obvious to those skilled in the art that various changes and modifications may be made therein without departing from the scope of the invention as defined by the appended claims.

What is claimed is:

1. A fluorescent lamp base comprising a metal housing;

metal pins for connection to a source of power;

an electrically insulated support member mounted in said metal housing, said electrically insulated support member supporting said metal pins and providing electrical insulation between said metal housing and said metal pins; and a resistive member for providing a high impedance electrical connection between said metal housing and one of said metal pins, said resistive member being of a material having a volume resistivity from about $10^5$ to about $10^8$ ohm-cm and a deflection temperature greater than 250° C. at 1,820 kilo dynes/cm$^2$; said resistive member being a washer shaped resistive member attached to one of said metal pins, said washer shaped resistive member being electrically connected to the inside surface of said metal housing and to one of said metal pins.

2. A fluorescent lamp base according to claim 3 wherein said material of said resistive supporting member is a conductive fiber glass reinforced polyester.

3. A fluorescent lamp base according to claim 1 wherein said resistive member has an aperture, said resistive member being attached to one of said metal pins, said resistive member being electrically connected to the inside surface of said metal housing and to one of said metal pins.

4. A fluorescent lamp comprising a light-transmitting envelope, electrodes, electrode leads, an inert ionizable gas, a charge of mercury, a coating of phosphor on the inside surface of said envelope, and a fluorescent lamp base comprising a metal housing, metal pins for connection to a power source, an electrically insulated support member mounted in the metal housing, and a resistive member, said resistive member being a washer shaped resistive member attached to one of said metal pins, said washer shaped resistive member being electrically connected to the inside surface of said metal housing and to one of said metal pins, said resistive member providing a high impedance electrical connection between said metal housing and one of said metal pins, said resistive member being made from a material having a volume resistivity from about $10^5$ to about $10^8$ ohm-cm and a deflection temperature greater than 250° C. at 1,820 kilo dynes/cm$^2$, said envelope having an electrically conductive strip on the exterior surface of said envelope, said electrically conductive strip terminating within the vicinity of said electrode leads, said fluorescent lamp base being attached to an end of said envelope and said metal housing of said fluorescent lamp base being electrically connected to said electrically conductive strip.

* * * * *

UNITED STATES PATENT AND TRADEMARK OFFICE

CERTIFICATE OF CORRECTION

PATENT NO. : 4,506,192

DATED : March 19, 1985

INVENTOR(S) : William D. Koenigsberg et al.

It is certified that error appears in the above-identified patent and that said Letters Patent is hereby corrected as shown below:

On the title page assignees should read

--(73) Assignees: GTE Laboratories Incorporated, Waltham, Mass.;

GTE Products Corporation, Stamford, Conn. --.

Signed and Sealed this

*Eighth* Day of *October 1985*

[SEAL]

*Attest:*

DONALD J. QUIGG

*Attesting Officer*

*Commissioner of Patents and Trademarks—Designate*